US005682863A

United States Patent [19]

Kadooka

[11] Patent Number: 5,682,863

[45] Date of Patent: Nov. 4, 1997

[54] EVAPORATED FUEL RECOVERY DEVICE FOR ENGINES

[75] Inventor: Hideharu Kadooka, Isehara, Japan

[73] Assignee: Nissan Motor Co., Ltd., Kanagawa, Japan

[21] Appl. No.: 722,890

[22] Filed: Sep. 23, 1996

[30] Foreign Application Priority Data

Sep. 22, 1995 [JP] Japan ..... 7-244998

[51] Int. Cl.[6] ..... F02M 25/08

[52] U.S. Cl. ..... 123/520

[58] Field of Search ..... 123/516, 518, 123/519, 520, 672, 673, 698

[56] References Cited

U.S. PATENT DOCUMENTS

| | | | |
|---|---|---|---|
| 4,465,048 | 8/1984 | Morozumi et al. | 123/438 |
| 5,263,460 | 11/1993 | Baxter et al. | 123/520 |
| 5,289,811 | 3/1994 | Covert et al. | 123/520 |
| 5,351,193 | 9/1994 | Poirier et al. | 123/520 |
| 5,551,406 | 9/1996 | Everingham et al. | 123/520 |

FOREIGN PATENT DOCUMENTS

| | | |
|---|---|---|
| 5-767 | 1/1993 | Japan . |
| 6-229330 | 8/1994 | Japan . |

*Primary Examiner*—Thomas N. Moulis

*Attorney, Agent, or Firm*—Lowe, Price, LeBlanc & Becker

[57] ABSTRACT

The ON/OFF frequency of a purge control valve is defined by a product of an integer and a frequency of REF signal, where the integer does not have a divisor equal to any of the divisors of the number of the cylinders of the engine, other than one. The engine is prevented from being supplied a purge gas concentratedly to a specific cylinder by opening the purge control valve for every five cylinders, for example.

2 Claims, 3 Drawing Sheets

EVAPORATED FUEL RECOVERY DEVICE FOR ENGINES

FIELD OF THE INVENTION

The present invention relates to a recovery of the fuel which is evaporated from the fuel tank of an automotive engine.

BACKGROUND OF THE INVENTION

The device for preventing the fuel evaporated in the fuel tank of the automotive engine from being released to the atmosphere is for example known as a fuel purge device. This device adsorbs the evaporated fuel in the fuel tank by a canister, mixes it with the air and supplies under a predetermined engine running condition to an intake passage of the engine.

This mixture is called a "purge gas", the flow rate of which is controlled by a purge control valve disposed in a purge passage connecting the canister and the intake passage. This purge control valve is a valve for opening and closing the purge passage in response to a pulse signal and is operated according to a duty ratio of the pulse signal.

Since the cycle of the suction stroke of each cylinder of the engine depends upon a rotation speed of the engine, the suction stroke of a specific cylinder and the open period of the purge control valve may be synchronized at a specific engine rotation speed so that the supply of the purge gas is concentrated to this specific cylinder. As a result, an engine rotation fluctuation called a "surge fluctuation" occurs if the air-fuel ratio in this specific cylinder is deviated due to the supply of the purge gas.

In order to cope with this problem, Tokkai Hei 6-229330 published by the Japanese Patent Office in 1994 has disclosed to change the ON/OFF frequency of the purge control valve in accordance with the engine rotation speed so that the purge control value, opening does not synchronize with the intake stroke of a specific cylinder.

According to this method, the cylinders to be fed with the purge gas are distributed in a steady engine running state so that the rotation of the engine hardly fluctuates.

For a transient engine running state, i.e., acceleration and deceleration, however, the interval between the intake strokes of the individual cylinders change sequentially. If the ON/OFF frequency of the purge control valve is calculated depending upon the engine rotation speed, a time lag occurs between the interval change in the intake stroke of each cylinder of the engine and the change in the ON/OFF frequency of the purge control valve. Due to this time lag, there still exists a possibility that the supply of the purge gas is concentrated in a specific cylinder during an acceleration/deceleration.

On the other hand, the aforementioned prior art has also disclosed to increase/decrease the ON/OFF frequency according to the elapsed time from the start of the purging. In this case, however, the supply of the purge gas may possibly be concentrated in a specific cylinder in the course of the change in the frequency no matter whether the engine running state might be steady or transient.

If the purge gas is thus supplied concentrateally to a specific cylinder, there arise not only the aforementioned rotational fluctuation of the engine but also the following problems.

The flow of the air in the intake passage of the engine is pulsated as the intake valve is opened and closed. As a result, the amounts of air to be aspirated into the individual cylinders become different depending upon the timings at which the intake valves are open, which causes a dispersion in the air-fuel ratios in the individual cylinders. When the purge gas is supplied to the cylinder in which the air-fuel ratio is enriched due to this intake pulsation as described above, the air-fuel ratio in this cylinder is further enriched by the supply of the purge gas. In other words, the concentration of the purge gas to a specific cylinder promotes the dispersion in the air-fuel ratio between the cylinders. As a result, in the engine, in which the exhaust gas is purified by a catalytic converter using a three-way catalyst, the performance of purifying the exhaust gas by the catalytic converter may be deteriorated.

In order to prevent the rotational fluctuation of the engine and the dispersion of the air-fuel ratio between the cylinders due to the purge gas supply, it is sufficient to distribute the purge gas equally to the individual cylinders. In the evaporated fuel recovery device for controlling the flow rate by using the duty-controlled purge control valve, however, the flows in the purge passage are essentially intermittent. In order to smoothen these intermittent flows, the ON/OFF frequency of the purge control valve may be increased to a high range. However, this increase is restricted to a predetermined extent by the limit which is based upon the inertial resistance of the valve body of the purge control valve.

In this context, Tokkai Hei 5-0767 published by the Japanese Patent Office in 1993, has disclosed to open and close the purge passage in a high frequency by providing a plurality of purge control valves and making their ON/OFF timings different.

In this case, even if the ON/OFF frequencies of the individual purge control valves are not made so high, the flows are smoothened as if a high frequency is applied to the operation of a single purge control valve. However, This method requires a plurality of purge control valves and accordingly a high cost to put this method into practice. Moreover, the combination of the purge control valves will deteriorate the accuracy of the control when the flow rate of the purge gas is small.

SUMMARY OF THE INVENTION

It is, therefore, an object of this invention to prevent the supply of the purge gas from being concentrated at a specific cylinder irrespective of the engine running conditions.

It is a further object of this invention to achieve the aforementioned object with a simple construction but without opening and closing a purge passage in a high frequency.

It is still a further object of this invention is to reduce the deviation in the air-fuel ratio even with the supply of the purge gas.

In order to achieve the above objects, this invention provides an evaporated fuel recovery device adapted to an engine in which an air-fuel mixture of air fed from an intake passage and fuel fed from a fuel tank is combusted sequentially in a plurality of cylinders. The device comprises a mechanism for adsorbing evaporated fuel in the fuel tank, a purge passage for supplying the fuel adsorbed by the adsorbing mechanism to the intake passage, and a purge control valve for opening and closing the purge passage periodically. The device further comprises a mechanism for outputting a reference signal corresponding to a predetermined stroke of each of the cylinders. An opening and closing frequency of the purge control valve is defined by a product of an integer and a frequency of the reference signal, where the integer does not have a divisor equal to any of the divisors of the number of the cylinders, other than one.

Preferably the device further comprises a mechanism for detecting a rotation speed of the engine and a mechanism for changing the integer into a smaller value when the rotation speed is low.

The details as well as other features and advantages of this invention are set forth in the remainder of the specification and are shown in the accompanying drawings.

DESCRIPTION OF THE PREFERRED EMBODIMENTS

Figure 1:
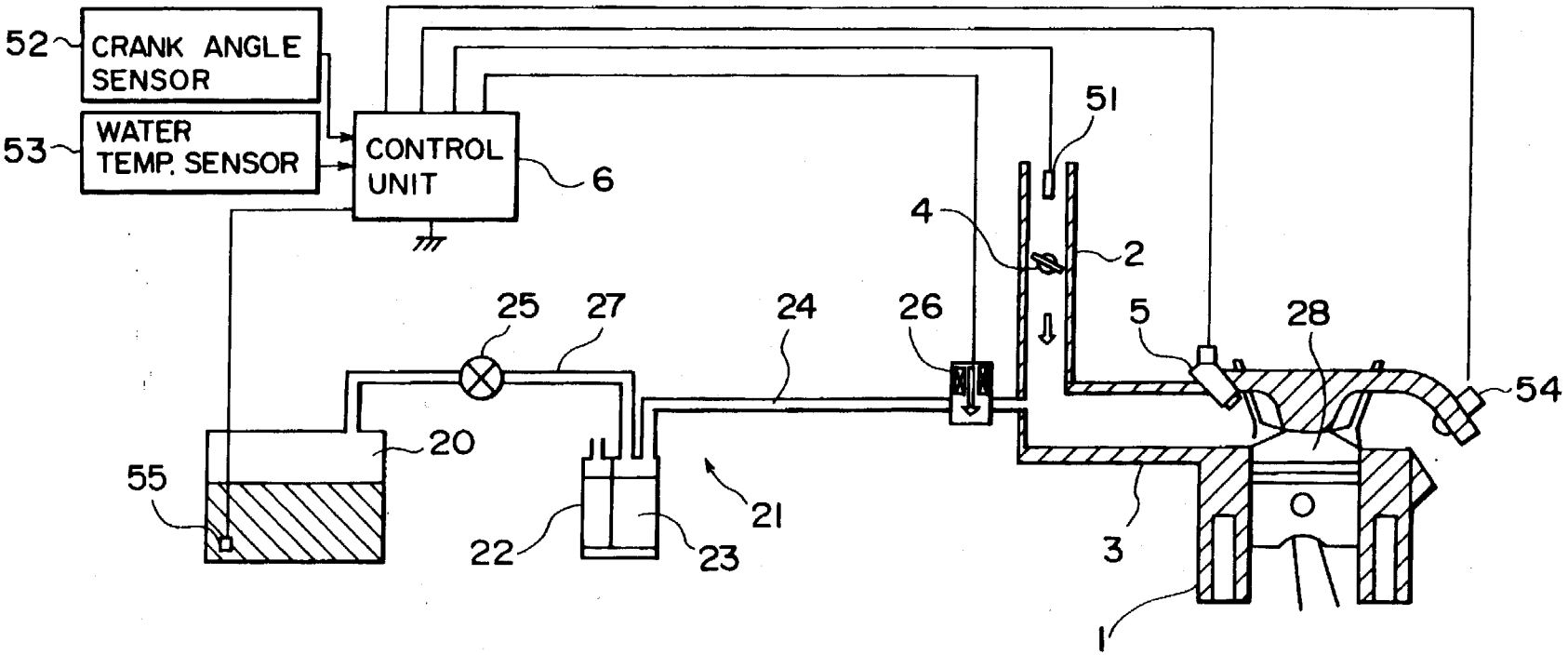
FIG. 1 is a schematic diagram of an evaporated fuel recovery device according to this invention.

Referring to FIG. 1 of the drawings, a four stroke cycle four-cylinder engine 1 for an automobile aspirates air into cylinders 28 through an intake pipe 2 and an intake manifold 3.

The intake pipe 2 is equipped with a throttle 4 for adjusting an take air flow rate Q of the engine 1. The intake manifold 3 is equipped therein with an electromagnetic injector 5 for each cylinder. The fuel is pumped under a predetermined pressure from a fuel tank 20 through a fuel pump and a pressure regulator not shown to the injector 5, by which it is injected into the intake manifold 3 in response to a pulse signal input from a control unit 6.

The fuel injection amount of the injector 5 is proportional to the duration of the pulse signal.

The engine 1 is provided with a recovery device 21 for supplying evaporated fuel in the fuel tank 20 to the engine. This recovery device 21 is equipped with: a canister 23 connected through an evaporated fuel passage 27 to the fuel tank 20; a purge passage 24 connecting the canister 23 to the intake pipe 2 at the downstream of the throttle 4; and a purge control valve 26 disposed midway in the purge passage 24. The purge control valve 26 is an electromagnetic valve opened and closed in response to a control signal input from the control unit 6. This operation of the purge control valve 24 is performed on the basis of the duty ratio of the control signal.

The evaporated fuel passage 27 is equipped with a check valve 25 which is opened when the fuel vapor pressure in the fuel tank 20 exceeds a predetermined level.

Upstream of the throttle 4 in the intake passage 2, there is disposed an air flow meter 51 for detecting an intake air flow rate Q of the engine 1.

There are further provided: a crank angle sensor 52 for detecting a rotation speed N of the engine 1; a water temperature sensor 53 for detecting a cooling water temperature Tw of the engine 1; an air-fuel ratio sensor 54 for detecting an air-fuel ratio of an air-fuel mixture to be supplied to the engine 1, from an oxygen concentration in the exhaust gas of the engine 1; and a fuel temperature sensor 55 for detecting a fuel temperature in the fuel tank 20. The output signals of these sensors are individually input to the control unit 6.

The crank angle sensor 52 outputs a reference signal REF each time the four stroke cycle four-cylinder engine I rotates 180 degrees. This reference signal REF is a signal for providing a reference for the injection timing of each cylinder of the engine 1 and corresponds to a predetermined angular position from the top dead center of each cylinder. The crank angle sensor 52 outputs a unit angle signal, too, at a unit crank angle, namely, each time the engine rotates one degree. The rotation speed N of the engine 1 is detected by counting the unit angle signals over a predetermined time period. Moreover, the intake stroke of each cylinder is accurately detected by counting the unit angle signals from when the reference signal REF for each cylinder is input.

On the basis of the input signals coming from the aforementioned individual sensors, the control unit 6 controls not only the fuel injection amount of the injector 5 and the ignition timing of the injected fuel but also the operation timing of the purge control valve 26 under a predetermined engine running condition to purge the evaporated fuel adsorbed by the canister 23 to the intake passage 2.

Figure 2:
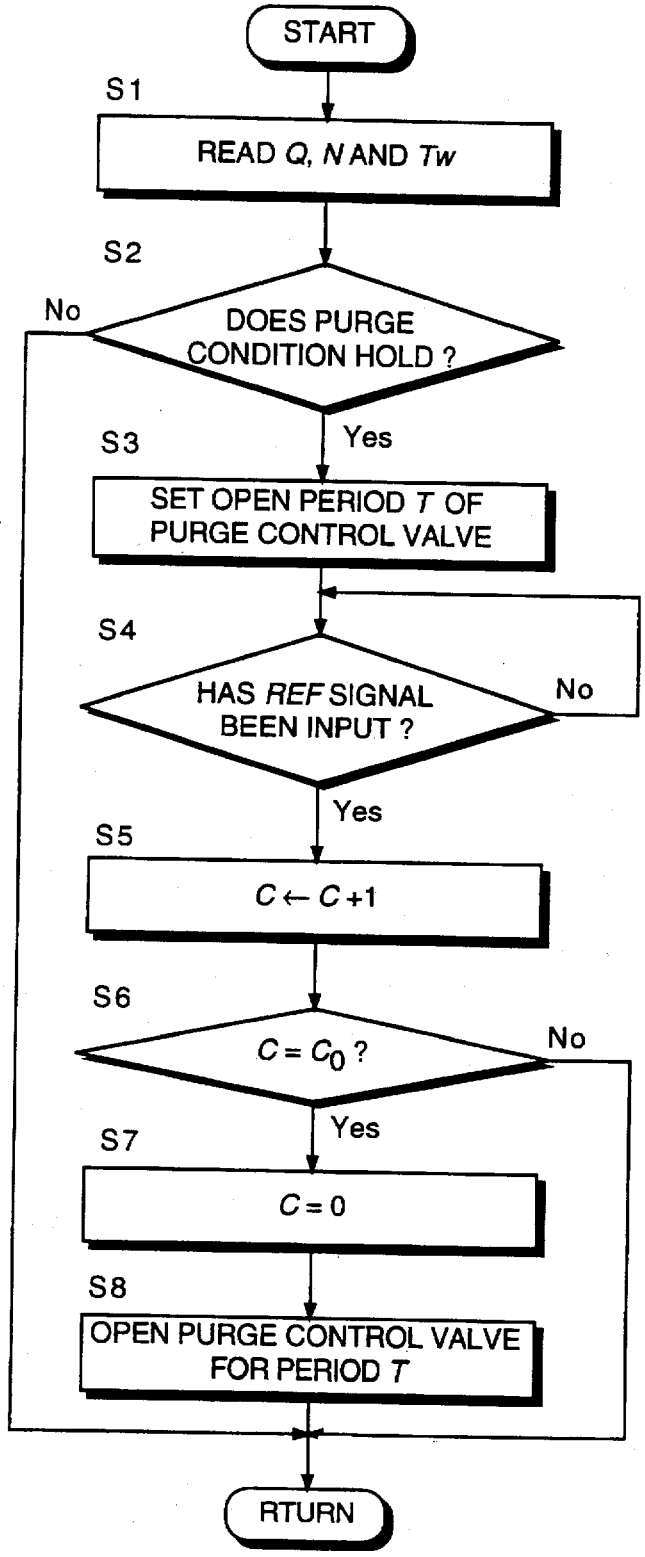
FIG. 2 is a flow chart for explaining a process for controlling a purge control valve according to this invention.

The process for controlling the purge control valve 26 by the control unit 6 will now be described with reference to the flow chart of FIG. 2. This routine is performed substantially at each signal REF, as defined by a later-described step S4.

In a step S1, the control unit 6 reads in the intake air flow rate Q detected by the air flow meter 51, the engine rotation speed N detected by the crank angle sensor 51, and the cooling water temperature Tw detected by the water temperature sensor 53.

In a step S2, those data are compared with predetermined values, respectively, In order to determine whether or not a predetermined purging conditions are satisfied. If the purging condition do not hold, the routine execution at this time is terminated.

If the purging conditions hold, the routine proceeds to a step S3, at which an open period T of the purge control valve 26 is determined. This open period T is determined in accordance with the running regions which are defined by the engine rotation speed N and a basic injection amount Tp of the injector 5, and is expressed in terms of a pulse width. For this determination, the control unit 6 is stored with a map which determines the open period of the purge control valve 26 in accordance with the engine rotation speed N and the basic injection amount Tp. In the step S3 the open period of the purge control valve 26 is looked up in this map. The method of determining the open period of the purge control valve 26 is disclosed in the prior art Tokkal Hei 6-229330 published by the Japanese Patent Office in 1994.

In a step S4, it is determined whether or not the reference signal REF has been input from the crank angle sensor 52 after this routine was executed. If the reference signal REF has been input, the counted value C of the counter is incremented by 1 in a step S5, and the routine proceeds to a step S6. If the reference signal REF has not been input, the routine is queued till the reference signal REF is input.

Next in a step S6, it is determined whether or not the counted value C of the counter has reached to a set value $C_0$ that is set in advance according to the cylinder number of the engine 1. If $C=C_0$, the routine proceeds to a step S7, in which the counted value C is reset to zero, and then the routine proceeds to a step S8. If, C is not equal to $C_0$, the execution of this routine is terminated.

The set value $C_0$ is defined as follows.

In this engine 1, the divisor of the cylinder number 4 other than 1 is 2. The set value $C_o$ may be any integer having a divisor other than 2. In other words, the set value $C_0$ may be set to any of integers 3, 5, 7, 9, 11, - - - , and so on other than the multiples of 2. In this embodiment, $C_0$ is set to 5.

In a step S8, the execution of this routine is terminated by outputting a pulse signal corresponding to the open period T, as determined in the step S3, to the purge control valve 26. By outputting the pulse signal in the step S8, the purge control valve 26 is opened over the period T, for which the purge gas is supplied to the intake passage 2. Most of the purge gas, thus supplied to the intake passage 2, is supplied to a cylinder in which the intake valve is open, i.e., a cylinder in the intake stroke.

Figure 3:
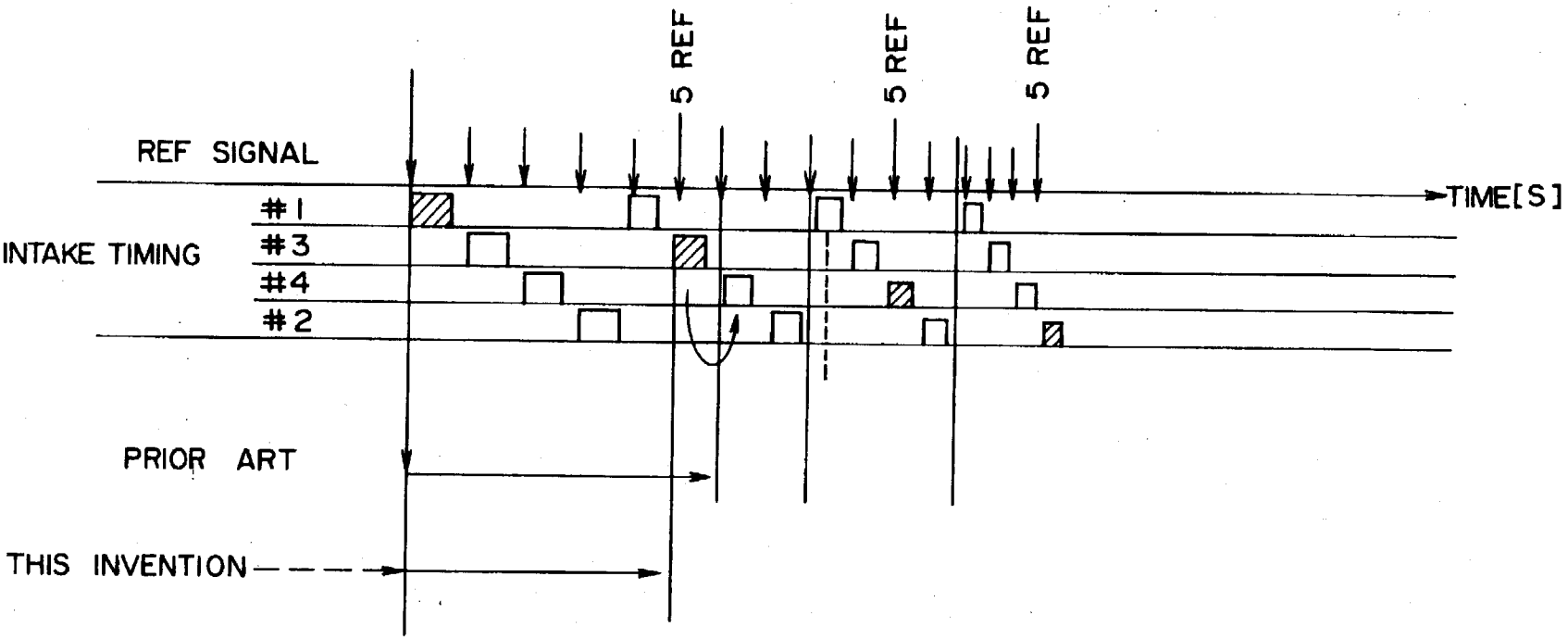
FIG. 3 is a timing chart for explaining the relations of a timing at which the purge control valve is opened under the control according to this invention, and a timing at which the purge control valve is opened under the control according to the prior art, to the intake strokes of the individual cylinders of an engine.

Since this routine is executed substantially each time the reference signal REF is input to the control unit 6, and the set value $C_0$ for counting the reference signal REF is set to 5, therefore, the purge control valve 26 is opened once each time the REF signal is input five times, as shown in FIG. 3, as long as the purge conditions are satisfied. In the engine 1 in which the four cylinders repeat the intake stroke in a predetermined order, therefore, the cylinders to which the purge gas is supplied are shifted in the predetermined order of #1-#3-#4-#2, as indicated by hatched parts in FIG. 3.

FIG. 3 shows a state in which the engine is accelerating. The purge control valve 26 is opened on the basis of the counted value of the reference signal REF. Even when the interval of the intake strokes between the cylinders is shortened by the acceleration, the pattern remains unchanged so that the purge gas never fails to be supplied to every five cylinders. In other words, the individual cylinders are supplied in the predetermined order with the purge gas no matter whether the vehicle might be cruising, accelerating or decelerating. This eliminates the phenomenon that the purge gas is continuously supplied to a specific cylinder in which the air-fuel ratio is already enriched by the pulsation.

In the case of the aforesaid prior art Tokkai Hei 6-229330, the ON/OFF frequency of the purge control valve 26 is changed according to the engine rotation speed. If the ON/OFF frequency of the purge control valve 26 was set according to the rotation speed when the acceleration starts in FIG. 3, the change in the ON/OFF frequency of the purge control valve 26 would not follow the increase in the engine rotation speed. In the prior art device, therefore, the purge gas may possibly be supplied to an adjoining cylinder #4 although it should be supplied to the cylinder #3 in the device according to this invention. Since this discrepancy is different depending upon the acceleration/deceleration of the engine, the purge gas may be continuously supplied to the cylinder #1 in dependence upon the acceleration/deceleration.

This device is not given a function to open/close the purge passage 24 in a high frequency so that it cannot smoothen the flow of the purge gas. However, the device reliably distributes the cylinders to be fed with the purge gas. Hence, the device can prevent the fluctuation of the rotations of the engine 1, as described above, and can avoid the drawback that the purging promotes the deviation of the air-fuel ratio in a specific cylinder due to the intake pulsation.

Since $C_0$ is set to 5 in this embodiment, the purge gas is supplied to a cylinder once at every five REF signals. If on the other hand, $C_0$ is set to 3, the purge control valve 26 is opened once for every three REF signals. So long as the set value $C_0$ belongs to any of the integers satisfying the aforementioned definitions, the purge gas is prevented from being continuously fed to the same cylinder.

For a six-cylinder engine having an intake stroke set at an interval of 120 degrees, the cylinder number 6 has divisors 2 and 3 except 1. Hence, the value $C_0$ is set to any of the integers excepting the multiples of 2 and 3, that is, to any of 5, 7, 11, - - - , and so on.

The set value $C_0$ is fixed in this device. However, it is preferable for reducing the fluctuation range of the air-fuel ratio to change the value $C_0$ in accordance with the engine rotation speed N. Specifically, while the engine is revolving at a low speed, the reference signal REF takes a long output period so that the number of feeds of the purge gas per unit time is small. If, at this low speed revolution, the set value $C_0$ is selected to have a small value from those satisfying the aforementioned definitions, the number of feeds of the purge gas per unit time increases. As a result, the number of such cylinders that have a deviation in the air-fuel ratio increases, but the deviation amount decreases.

The embodiments of this invention in which an exclusive property or privilege is claimed are defined as follows:

1. An evaporated fuel recovery device adapted to an engine in which an air-fuel mixture of air fed from an intake passage and fuel fed from a fuel tank is combusted sequentially in a plurality of cylinders, comprising:

means for absorbing evaporated fuel in said tank, a purge passage for supplying the fuel absorbed by said absorbing means to said intake passage, a purge control valve for opening and closing said purge passage at a predetermined frequency, means for outputting a reference signal corresponding to a predetermined stroke of each of said cylinders, and means for setting said frequency equal to a product of an integer and a frequency of said reference signal, where said integer does not have a divisor equal to any of the divisors of the number of said cylinders, other than one.

2. An evaporated fuel recovery device as defined in claim 1, further comprising means for detecting a rotation speed of said engine and means for changing said integer into a smaller value when said rotation speed is low.

* * * * *